United States Patent [19]

Stockdale

[11] 4,074,248

[45] Feb. 14, 1978

[54] DUAL OPERATING CONTROL CIRCUITS FOR INTRUSION DETECTION SYSTEMS

[75] Inventor: Roy Stockdale, Huntington, N.Y.

[73] Assignee: Napco Security Systems, Inc., Copiaque, N.Y.

[21] Appl. No.: 743,539

[22] Filed: Nov. 22, 1976

[51] Int. Cl.[2] ..... G08B 13/08

[52] U.S. Cl. ..... 340/276; 340/256; 340/274 R

[58] Field of Search ..... 340/256, 276, 274 R, 340/421

[56] References Cited

U.S. PATENT DOCUMENTS

| | | | |
|---|---|---|---|
| 3,534,350 | 10/1970 | Sellinger et al. | 340/274 R |
| 3,757,319 | 9/1973 | Hedin | 340/274 R |
| 3,803,576 | 4/1974 | Dobrzanski et al. | 340/276 |

*Primary Examiner*—Glen R. Swann, III
*Attorney, Agent, or Firm*—Arthur L. Plevy

[57] ABSTRACT

A series loop is in series with a control relay coil which has a first and a second contact. The first contact is coupled to an alarm and the second contact is coupled to one end of the loop. A control arm of the relay is operated by the coil to coact with said first contact when the coil is not energized and to coact with the second contact when the coil is energized to cause said second contact to latch said relay when the series loop is closed. Power is selectively applied to the control arm of the relay and a unidirectional current conducting circuit is coupled between the control arm of the relay and the second contact. The circuit supplies energizing current to the coil in the loop for the application of power to the control arm. This causes the relay to operate and therefore to latch if the loop is closed upon application of power to the control arm. The system user also is afforded a predetermined time to break the loop for purposes of leaving the premises and due to the nature of the unidirectional circuit, is assured that the intrusion system will be placed in a secured mode after the loop is broken.

10 Claims, 2 Drawing Figures

DUAL OPERATING CONTROL CIRCUITS FOR INTRUSION DETECTION SYSTEMS

BACKGROUND OF INVENTION

This invention relates to intrusion detection systems and more particularly to a control circuit for use with such a system.

As is known, burglar alarms, fire alarms or detection systems in general have found widespread use and hence, the prior art is replete with many types of such systems.

Essentially, the systems are operative to detect an intrusion on a premises which is monitored and to sound an alarm or provide an indication when an unauthorized intrusion occurs. It is understood that the term "intrusion" is used in its generic sense and hence such an intrusion may indicate the presence of a burglar, fire, or some other undesired condition on the premises or location which is being monitored by the intrusion system.

As is conventional, such systems are placed into operation when the premises are secured as after working hours or during a period of closing as a vacation and so on. Hence, in order to place the system in an operating mode, one usually activates a switch or other device to energize the system. The switch may be operated from a location remote from the premises to be secured or operated on the premises. If the system is activated on the premises, the system usually employs a time delay or a disabling mode to enable the operator to leave the premises through a door exit which is monitored by the system. Hence, his leaving if not for a time delay or other inhibiting device, could undesirably trigger or operate the system.

The prior art therefore has a plurality of techniques for enabling one to activate a system on the premises to thereafter exit without triggering the intrusion alarm or the intrusion mode. Many such devices are complicated, require additional circuits and other components and hence, serve to increase both the complexity and cost of such systems.

It is therefore an object of the present invention to provide an improved control circuit for use with an intrusion system to enable exit delay while further providing an automatic setting feature to enable reliable operation while further reducing the complexity and cost of such systems.

BRIEF DESCRIPTION OF PREFERRED EMBODIMENT

An intrusion detecting system comprises in combination a series loop positioned about an area to be monitored and providing a low impedance series path when said area is secured and a high impedance path when said area is intruded upon, a switching means having a current controllable actuator and a first and second contact, a control arm adapted to coact with said first contact when a current flows through said actuator and to coact with said second contact during the absence of a current through said actuator, said controllable actuator coupled in series with said loop, with said first contact coupled to one end of said loop, a unidirectional current conducting means coupled between said first contact and said control arm, alarm means coupled to said second contact, means for selectively applying a bias potential to said control arm to cause said unidirectional means to conduct to thereby cause a current to flow through said first contact and said loop and therefore through said actuator, to cause said control arm to coact with said first contact, thus directing said bias potential to said loop when said area is secured and for directing said bias potential to said alarm means when said loop is opened due to said control arm accessing said second contact.

DETAILED DESCRIPTION OF THE FIGURES

Figure 1:
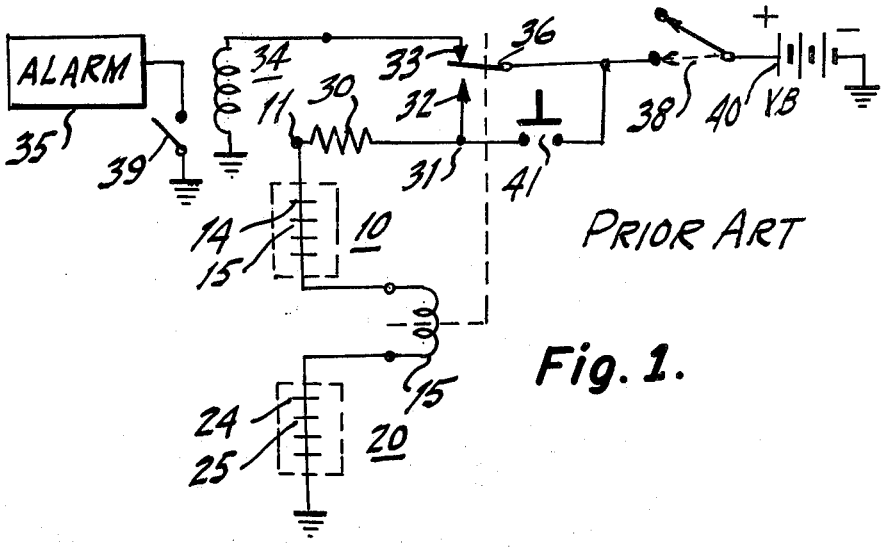
FIG. 1 is a circuit schematic of a prior art control unit used in explaining certain operating characteristics of intrusion systems.

Referring to FIG. 1, there is shown a prior art intrusion system employing a control circuit. Basically, the system serves to monitor a plurality of areas which may be rooms in a building or secured areas in a laboratory and so on. The areas are designated by numerals 10 and 20 and are shown schematically within dashed lines. Within the dashed lines referenced as 10 and 20 are a series of normally closed contacts as 14,15, and 24 and 25. Such closed contacts may represent normal security sensors such as mercury switches, magnetic switches, conductive tape, thermostats and so on. Hence, an area as 10 to be monitored may include a number of windows, doors and control areas, which are associated with a sensor. The sensor is in a closed position when the window or door is closed or secured and will open when the window or door is opened or broken or when the heat in an area rises above the thermostat setting afforded by one of the sensors. Hence, a series of such sensors as 14 and 15 associated with an area is referred to as a control loop and such a loop is normally closed for the secured position of such sensors. The control loop associated with area 10 is in series with a relay coil 15 and the control loop associated with area 20. One end of the control loop 20 is coupled to a point of reference potential. Thus, the control loops 10 and 20 form a series path to ground with the relay coil 15 part of the same. One end 11 of the control loop 10 is directed through a resistor 30 to a terminal 31 associated with a control panel or control box. As can be clearly understood by referring to the FIG. 1, is the fact that many additional control loops as 10 and 20 can be included in the arrangement shown.

Terminal 31 is coupled to a contact 32 associated with the relay coil 15. Another contact 33 is coupled to an alarm circuit 35, which may be accessed via a relay coil 34.

The alarm device 35, which may be a bell, siren, light or some other visual or audible alarm mechanism, is operative to provide an indication of an intrusion when activated. If the alarm 35 is operative by the DC level supplied by the battery 40, it can be directly coupled to contact 33. If not, than a relay coil 34 can be energized by contact 33 and a contact 39 of relay 34 can operate the alarm 35.

Contacts 32 and 33 may be accessed by a control arm 36 associated with the coil 15 and hence, the position of arm 36 as controlled by the operation of coil 15 can be switched between contact 32 and 33. This relay comprising the coil 15, and contacts 32,33 and arm 36 is a single pole double throw device. Many types of such relays as well as semiconductor equivalents are known and employed in the prior art. The control arm 36 is coupled to a source of operating potential (VB) via a key switch 38. The key switch 38 is a single pole, double throw switch and is operative in a first position (shown) such that the battery (V*b*) 40 is not coupled to the control arm 36 and in a second position (dashed) to couple the same thereto. Also shown coupled between the control arm 36 and terminal 31 is a momentary control switch 41 or push-button switch. Switch 41 will connect control arm 36 to terminal 31 when it is depressed and thereafter will resort to the off position as shown. Such momentary switches 41 are also well known as well as the semiconductor equivalents of such switches.

The operation of the system depicted in FIG. 1 is as follows:

When one wishes to activate the system, it is first ascertained that the loops 10 and 20 are closed and hence, all areas are secured. Thus, a low impedance path is provided from terminal 31 to ground or reference potential through the loops 10 and 20, relay coil 15 and resistor 30 as shown.

The operator then operates the switch 38 to connect battery potential to the alarm circuit 35 via the relay coil 34 and contact 39. Thus, when operating switch 38 to the closed or on position, power is supplied to the alarm 35 via the contact 33 and hence, the alarm will sound thus verifying operation to the user. The user then depresses switch 41. If the loops 10 and 20 are intact, current is directed from the source 40 through the series path and hence, relay coil 15 operates. Thus, control arm 36 contacts terminal 32 to self-lock the relay via contact 32 which now supplies power to the coil. The alarm 35 is no longer activated and hence, if the loops are intact, the circuit will operate the alarm when one of the sensors as 14,15 or 24,25 is opened. As can be seen, if a loop 10 or 20 is broken, the relay coil is deenergized and the contact 33 operates the alarm. Thus, it is noted that if the user after performing the above noted operation, desires to leave the premises via a door which is monitored by one of the loops, he will activate the system. Hence the key switch 38 may be located on the outside of the premises to be operated after he has secured the door by leaving or one may employ a separate timer or a shunt switch to prevent the alarm from sounding until he leaves the permises. The additional component and circuitry adds expense to the control circuit and further complicates the circuit.

The above noted circuit (FIG. 1) is widely used in such systems and is sometimes referred to as a "stick" circuit. The circuit as shown uses a single relay and hence is a relatively simple control unit. While a battery 40 is shown, it is known to use a power supply to energize the same from the AC lines or to use both a power supply and a battery for stand-by operation in conjunction with the circuit of FIG. 1.

Figure 2:
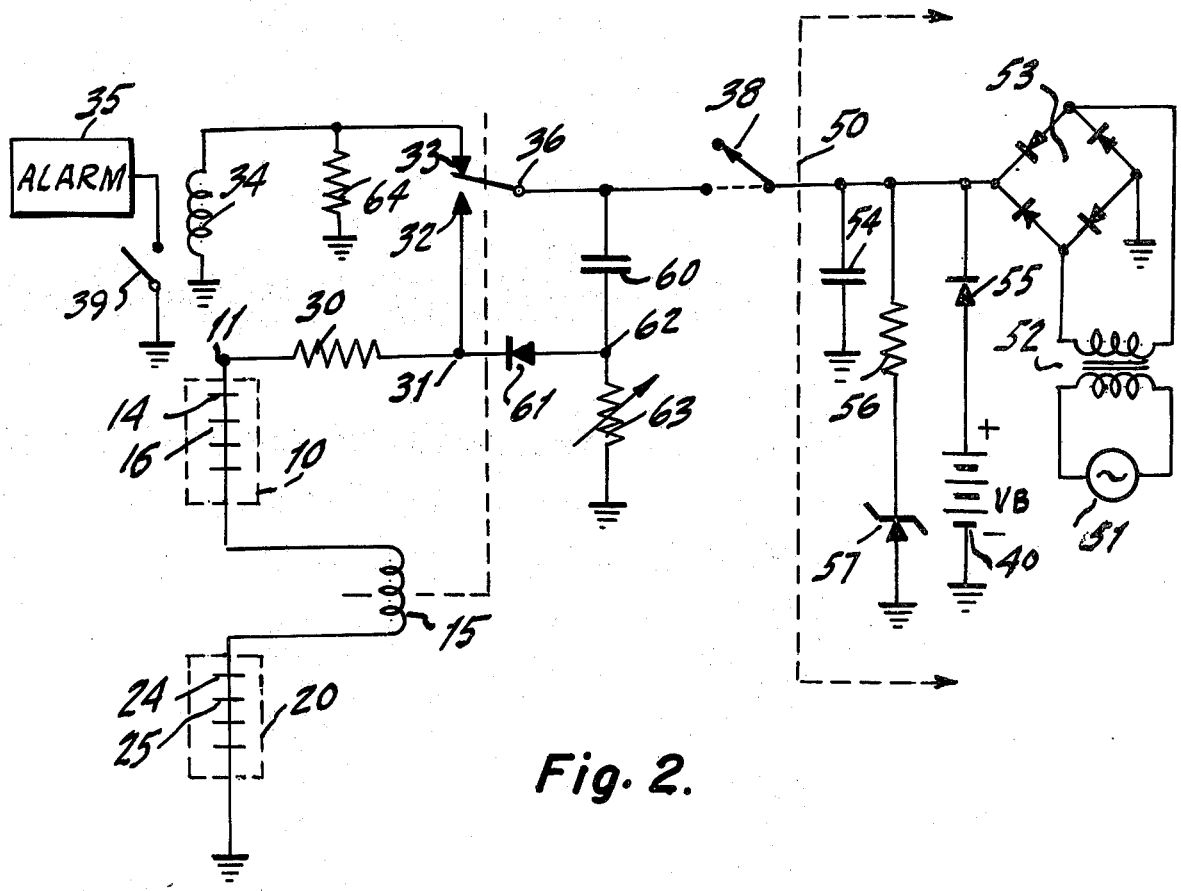
FIG. 2 is a circuit schematic of a control unit according to this invention.

Referring to FIG. 2, there is shown an improved control circuit and since many components perform identical functions, similar reference numerals have been employed for similar parts to enable one to more clearly compare the differences and to relate to the function with greater clarity.

Shown in FIG. 2, is a dashed line 50. It is noted at the onset that a battery such as 40 could be coupled directly to the key switch 38 as shown in FIG. 1 and the operation of the circuit of FIG. 2 would be identical to that about to be described. In any event, the circuitry to the right of line 50 is an AC power supply operative with a battery stand-by source (V*b*) to enable the system to operate when a power failure occurs. Such stand-by systems are well known in the art. Briefly, the AC line 51 is coupled to the primary of a transformer 52. The secondary winding of transformer 52 is applied to a diode bridge rectifier 53 whose output is filtered by a smoothing capacitor 54 to provide a DC voltage at the input to key switch 38. A battery 40 is coupled via a diode 55 to the output of the rectifier bridge 53. A resistor 56 is coupled in series with a zener diode 57 and the series combination is in shunt with the series path of battery 40 and diode 55. The zener 57 and resistor 56 serve to recharge the battery during AC operation.

Briefly, if the AC source fails, the diode 55 is forward biased by battery 40 and supplies power to the intrusion circuitry for failure of the AC line or for low voltage. Hence, during normal operation, the voltage supplied by the rectifier bridge 53 across capacitor 54 is slightly higher than the battery voltage. Hence, the diode 55 is reversed biased under these conditions. As noted above, a battery 40 can be connected directly to the key switch as in FIG. 1 without affecting circuit operation.

Before proceeding in explaining the operation, it is again noted that the loops 10 and 20 are in series with the relay coil 15 between ground and terminal 31 of the control unit. It is noted that the coil 15 controls the contacts 32 and 33 via the arm 36 and that the contact 33 is coupled to the relay 34 of alarm circuit 35 as above described, while contact 32 is again coupled to terminal 31 of the control circuit. In any event, the control arm 36 is AC coupled via a capacitor 60 and a diode 61 to terminal 31. The diode 61 has its cathode coupled to terminal 31 and its anode coupled to the terminal 62 of capacitor 60. The terminal 62 is further coupled to a point of reference potential via a resistor 63. Also shown is a resistor 64 which is in shunt with the alarm relay 34 of the alarm circuit 35. Thus, as seen the major differences between the circuits of FIG. 1 is the inclusion of the capacitor 60, diode 61, resistors 63 and 64 and the absence of the momentary switch 41. It is noted that a mechanical device 41 has been replaced by electrical components and hence, reliability and life of the equipment is extended. Furthermore, the operation, as will be explained, removes the requirement that the operator be forced to depress a switch as 41, as the activation of the system is automatic.

In the system depicted in FIG. 2, the operator again, assuming that the loops 10 and 20 are intact, operates the key switch 38; the bell or alarm 35 sounds initially as energized via contact 33 as above. Capacitor 60 is discharged when the switch 38 is activated. The voltage across capacitor 60 cannot change instantaneously and capacitor 60 begins to charge, but the current through the capacitor 60 is quite large and hence, current flows via capacitor 60 through resistor 30 and the series loop and hence, relay coil 15 is activated. Control arm 36 latches the relay coil via contact 32 as above described and the circuit is automatically set. Thus, the operator will immediately note that the bell or alarm is now off thus assuming that the relay 15 is operating and that loops 10 and 20 were intact.

In any event, the value of resistor 63 and capacitor 60 are selected to make the time constant sufficiently high to now give the operator adequate time to leave the premises and break a loop while further assuring that the relay 15 will operate again. Since the time constant of capacitor 60 and resistor 63 is high, the operator will have this time, determined by the time constant, to leave the premises when capacitor 60 is charging. Assume that the operator leaves the premises and breaks the loop 10. The following events occur:

The loop 10 being broken causes relay coil 15 to deenergize. The contact 33 activates the alarm 35. However, the capacitor 60 is still charging via resistor 63 and from the supply terminal. When the operator closes the door, the loop 10 is restored and hence, the current through the capacitor is directed via the low impedance loop in lieu of resistor 63. Thus, the relay coil is activated again and latches as described above. Once capacitor 60 is fully charged, it behaves as a battery and hence, if an intruder enters, the loop is broken, capacitor 60 is charged and the relay 15 due to the opening of the loop, drops out to sound the alarm. If the intruder closes the door immediately upon hearing the alarm, the relay will not activate again due to the fact that the capacitor 60 will not charge to any significant value and hence, there is not sufficient current in the loop to activate the relay and the alarm continues.

Thus, the above described circuit offers both an automatic setting of the loop and an automatic exit delay, while further eliminating a mechanical switch. The resistor 64 assures that the capacitor 60 will discharge completely when the key switch 38 is in the off position (shown) to enable the above described operation at typical intervals.

A circuit which operated according to the above teaching included the following component values:

| COMPONENT | VALUE |
|---|---|
| Transformer 52 | 110 to 8.8 V.A.C. |
| Battery 40 | 6 volt |
| Zener 57 | 6.5 volt |
| Resistor 56 | 27 ohms |
| Capacitor 54 | 500 microfarads |
| Capacitor 60 | 500 microfarads |
| Diode 61 | IN 4002 |
| Resistor 30 | 22 ohms (5w) |
| Relay and Coil 15 | SPDT - 120 ohm coil impedance |
| Resistor 64 | 1,000 ohms |
| Variable Resistor 63 | can vary from 10,000 to 50,000 ohms to determine exit delay time from 5 seconds to greater. |

It is noted that the above values are representative and any suitable values as well as different operating potentials can be used accordingly and such modifications should be apparent to one skilled in the art when reading this speficiation.

Resistor 63 is shown as a variable resistor and can be so employed to allow a user to preselect the time desired to exit according to his own preference or a fixed value resistor can be appropriately selected.

I claim:

1. An intrusion detection system comprising:

(a) a series loop including a plurality of intrusion sensing devices operative in a first closed position to indicate a secured condition and a second opened position to indicate an intrusion, (b) control means adapted when energized to operate in a first position and in a second position when deenergized, said control means including a current activated actuator to operate said control means to said first position when a current flows through said actuator and means for coupling said actuator in series with said loop, (c) an alarm coupled to said control means and responsive to said control means operative in said second position to indicate an alarm condition, (d) means for providing a biasing current of a predetermined duration to said loop and hence, said actuator, in a first mode, to cause said actuator to operate said control means to said first position and (e) means responsive to said control means operative in said first position for providing a second current to said loop, wherein if said loop is opened and closed during said predetermined duration, said means for providing a biasing current will again operate said actuator, and thereafter said actuator is biased by said means responsive to said control means.

2. The intrusion detection system according to claim 1 wherein said control means includes a relay having a current actuated coil, a first and second contact for access by a control arm which coacts with said first contact when current flows in said coil and said second contact when deenergized, said coil coupled in series with said loop with said first contact coupled to said loop.

3. The intrusion detection system according to claim 2 wherein said means for providing a biasing current to said loop comprises a capacitor in series with a unidirectional current device and coupled between said control arm of said relay and said first contact to supply for said predetermined duration said biasing current to said coil when said second contact is accessed.

4. The intrusion detection system according to claim 3 further comprising a resistor having one terminal coupled to the juncture between said capacitor and said current device and the other terminal coupled to a point of reference potential.

5. In an intrusion system of the type employing a series loop of normally closed sensing devices for indicating a secured situation, in series with a control relay coil having a first and a second contact, with said first contact coupled to an alarm means and said second contact coupled to one end of said loop, a control arm operative by said coil to a first position to access said first contact for energizing said alarm and to a second position for accessing said second contact to energize said loop and hence, said relay, to latch said relay in said second position when said loop is secured, a key switch coupled to said control arm and operative in a first position to apply operating potential to said control arm and in a second position to remove potential from said control arm, whereby when said key switch is in said first position and said series loop is secured, said relay coil is energized via said second contact and when said loop is open during said first position of said key switch, said coil is deenergized to cause said first contact to energize said alarm through said control arm, the improvement therein of apparatus for automatically activating said relay upon operation of said key switch in said first position, comprising:

unidirectional current conducting means coupled between said control arm and said series loop and operative to supply a predetermined current for a given duration to said loop when said key switch is operated to said first position, said predetermined duration selected according to a desired exit delay time.

6. The intrusion system according to claim 5 wherein said unidirectional current conducting means includes a capacitor having a first terminal coupled to said control arm and a second terminal, a unidirectional current conducting device having a first terminal coupled to said second contact of said relay and a second terminal coupled to said second terminal of said capacitor, a resistor coupled between said second terminal of said capacitor and a point of reference potential and selected in magnitude with respect to said capacitor to provide said given duration.

7. An intrusion detection system, comprising in combination:

(a) a series loop positioned about an area to be monitored and providing a low impedance series path when said area is secured and a high impedance path when said area is intruded upon, (b) switching means having a current controllable actuator and a first and second contact, a control arm adapted to coact with said first contact when a current flows through said actuator and to coact with said second contact during the absence of a current through said actuator; said controllable actuator coupled in series with said loop, with said first contact coupled to one end of said loop, (c) a unidirectional current conducting means coupled between said first contact and said control arm, (d) alarm means coupled to said second contact, (e) means for selectively applying a bias potential to said control arm to cause said unidirectional means to conduct to thereby cause a current to flow through said first contact and said loop and therefore through said actuator, to cause said control arm to coact with said first contact thus directing said bias pontential to said loop when said area is secured and for directing said bias potential to said alarm means when said loop is opened due to said control arm accessing said second contact.

8. The intrusion system according to claim 7 wherein said switching means is a relay having a current controllable coil in series with said loop and a control arm adapted to coact with said first contact when said coil is energized and said second contact when said coil is deenergized.

9. The intrusion system according to claim 7 wherein said unidirectional current conducting means includes a time delay circuit operative to cause said unidirectional circuit to conduct for only a predetermined duration indicative of an exit delay to supply operating current to said actuator to allow opening and closing of said loop during said duration.

10. The system according to claim 9 wherein said time delay circuit is adjustable to provide a range of predetermined delays.

* * * * *